United States Patent [19]

Wolf

[11] Patent Number: 4,477,222

[45] Date of Patent: Oct. 16, 1984

[54] MOUNTING CONSTRUCTION FOR TURBINE VANE ASSEMBLY

[75] Inventor: Daniel S. Wolf, North Palm Beach, Fla.

[73] Assignee: The United States of America as represented by the Secretary of the Air Force, Washington, D.C.

[21] Appl. No.: 431,435

[22] Filed: Sep. 30, 1982

[51] Int. Cl.[3] ..... F01D 9/04

[52] U.S. Cl. ..... 415/138

[58] Field of Search ..... 415/134, 137, 138, 139

[56] References Cited

U.S. PATENT DOCUMENTS

| | | | |
|---|---|---|---|
| 890,635 | 6/1908 | Fox | 415/139 X |
| 2,681,788 | 6/1954 | Wosika | 415/137 |
| 2,702,688 | 2/1955 | Ericson | 415/137 |
| 2,801,076 | 7/1957 | Terrell et al. | 415/138 X |
| 2,960,306 | 11/1960 | Collman et al. | 415/138 |
| 3,817,657 | 6/1974 | Hueber | 416/244 |
| 3,908,447 | 9/1975 | Salt | 73/91 |
| 4,191,509 | 3/1980 | Leonardi | 416/219 R |

*Primary Examiner*—Robert E. Garrett
*Assistant Examiner*—Joseph M. Pitko
*Attorney, Agent, or Firm*—Donald J. Singer; John R. Flanagan

[57] ABSTRACT

A turbine vane assembly of a gas turbine engine includes inner and outer shroud walls and a plurality of airfoil-shaped vanes extending between and connected at their opposite ends with the inner and outer shroud walls. The mounting construction of the vane ends to the respective shroud walls includes a plurality of recessed ledges defined in the shroud walls along respective ones of the ends of the vanes. Each ledge forms a gap between the respective wall and vane end extending from a trailing edge pressure side of the vane along the pressure side to a location approximately midway between the trailing and leading edges of the pressure side of the vane. The remainder of the vane end is rigidly connected to the respective shroud wall.

4 Claims, 5 Drawing Figures

MOUNTING CONSTRUCTION FOR TURBINE VANE ASSEMBLY

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The present invention broadly relates to vane assemblies in gas turbine engines and, more particularly, is concerned with an improved mounting construction for a high pressure vane which increases the fatigue life thereof.

2. Description of the Prior Art

In conventional gas turbine engines, working medium gases are compressed in a compression section of the engine and then flowed to a combustion section where fuel is mixed with the gases and burned to add energy to the flowing medium. The high energy medium is subsequently flowed to a turbine section where a portion of the energy is extracted and applied to drive the engine compressor.

The turbine section includes a plurality of alternating rows of rotor blades and stator vanes. Each row of stator vanes directs the working medium gases to a preferred angle of entry into the downstream row of rotor blades. The rotor blades in turn extract energy from the medium gases for driving the engine compressor.

One factor limiting the life of stator vanes is low fatigue life of the material from which the respective components are fabricated due to the thermal expansion of the material during engine operation. U.S. Pat. No. 3,908,446 to Salt recognizes that fatigue life of materials used in articles, such as parts found in gas turbine engine, is affected by the design of the articles. By changing the design to reduce the stress in a critical area, the useful life of the article may be increased. The Salt patent mentions several ways to change the design of the part to reduce stress, such as by changing the contour of a fillet or by reshaping or eliminating cavities or holes.

Absent from the prior art is a simple technique for constructing a turbine vane assembly so as to accommodate thermal expansion between its parts. In some conventional constructions, all of the parts are rigidly brazed together. Alternatively, in other conventional construction the parts of the assembly may be cast together as a single, integrally-formed piece. Neither of these constructions will permit differential thermal expansion between parts without increasing the incidence of material fatigue. Consequently, a need exists for a mounting construction which accommodates for differential thermal expansion in a simple and effective manner.

SUMMARY OF THE INVENTION

The present invention provides a mounting construction for a turbine vane assembly which is designed to satisfy the aforementioned needs. The unique feature of the vane assembly mounting construction is the provision of a gap between a portion of the shroud wall and an end of each vane of the assembly, while the remainder of the joint between the wall and vane end rigidly connects them together, such as by brazing. The objective of providing the gap is to increase the fatigue life of a high pressure vane by allowing free thermal expansion of its trailing edge pressure side at outer and inner shroud wall intersections therewith, and to do so in a way which is simple and low in cost for brazed vane construction.

Accordingly, the present invention is directed to a turbine vane assembly of a gas turbine engine which includes an inner shroud wall, an outer shroud wall, one or more airfoil-shaped vanes extending between and connected at their opposite ends with the inner and outer shroud walls, and a plurality of recessed ledges defined in the shroud walls along respective ones of the ends of the vanes. Each ledge forms a gap between the respective wall and the vane end extending from a trailing edge pressure side of the vane to a location approximately midway between the trailing edge and leading edge of the pressure side of the vane. More particularly, each gap extends along the vane pressure side approximately forty percent of the chord length of the vane end.

DETAILED DESCRIPTION OF THE INVENTION

Figure 1:
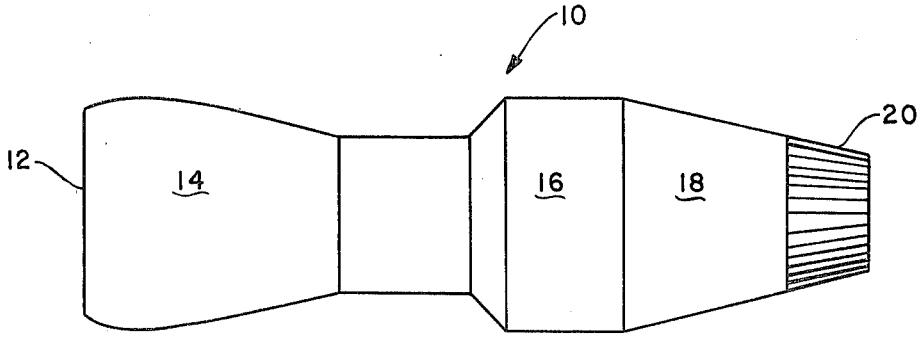
FIG. 1 is a side elevational view of a gas turbine engine which incorporates the vane assembly of the present invention.

Referring now to the drawings, and more particularly to FIG. 1, there is shown a gas turbine engine or powerplant, generally designated 10, which has an air inlet 12, a compressor section 14, a combustion section 16, a turbine section 18, and an exhaust section or duct 20.

In its general mode of operation, air enters the powerplant 10 through air inlet 12, is compressed as it passes through the compressor section 14, is heated in a power generating function by combustion chambers (not shown) of the combustion section 16, then passes through the turbine section 18 in a power extraction function, and, finally, is exhausted in jet exhaust fashion through the exhaust duct 20. The turbine section 18 includes a plurality of alternating rows (not shown) of rotor blades and stator vanes. Each row of stator vanes, comprised of a plurality of turbine vane assemblies 22 (one being shown in FIG. 2) connected together to form a ring (not shown), directs working medium gases from the combustion section 16 into a downstream row of rotor blades. The rotor blades then extract energy from the medium gases for driving the engine compressor of section 14.

Figure 2:
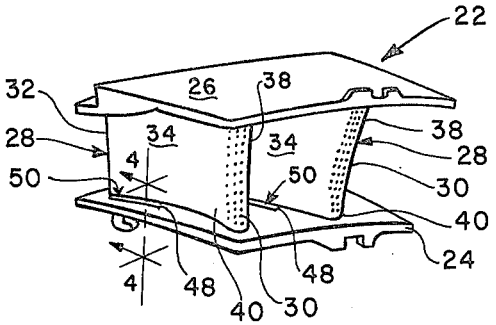
FIG. 2 is a perspective view of the vane assembly.

As shown in FIG. 2, each turbine vane assembly 22 preferably includes an inner shroud wall 24, an outer shroud wall 26 and a plurality of airfoil-shaped vanes 28 extending between and connecting with the walls 24, 26. (While two vanes are illustrated in the assembly 22, one vane or more than two vanes are also possible.) The walls are slightly arcuate in shape along their longitudinal axes, which extend generally perpendicular to the chord length of the vanes, such that when the walls of a plurality of such assemblies 22 are placed end to end they will form parallel annular shroud rings with a continuous row of vanes therebetween.

Figure 3:
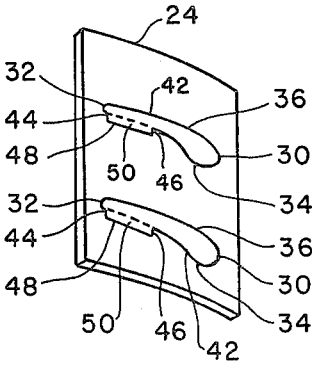
FIG. 3 is a different perspective view of one of the shroud walls, with the intersection of the wall and vane end, as well as the gap therebetween, shown in outline form.
Figure 4:
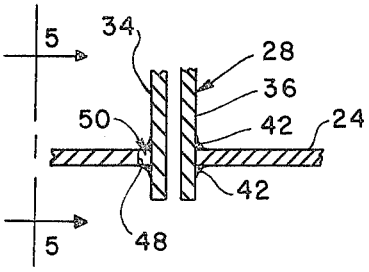
FIG. 4 is an enlarged fragmentary sectional view of the intersection of the shroud wall with the vane end taken along line 4—4 of FIG. 2.
Figure 5:
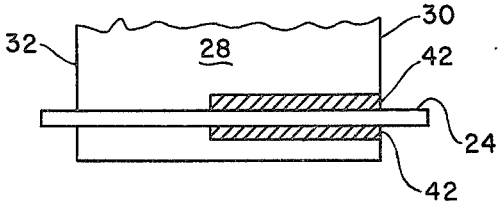
FIG. 5 is a fragmentary side elevational view partly in section, taken along line 5—5 of FIG. 4.

Each vane 28 has leading and trailing edges 30, 32 opposite pressure and suction sides 34, 36, and opposite upper and lower ends 38, 40. A continuous rigid connection 42, such as shown in outline form in FIG. 3, is provided between each shroud wall 24, 26 and each end 38, 40 of vanes 28 extending from a first terminus 44 at the trailing edge 32, along the suction side 36 to the leading edge 30 of side 36, around the leading edge 30, and to a second terminus 46 along the pressure side 34 located approximately intermediate of the leading and trailing edges 30, 32 of the vane pressure side 34. The connection 42 is preferably made by a conventional brazing operation.

In accordance with the principles of the present invention, a recessed ledge 48 is defined in each shroud wall 24, 26 (not shown in wall 26) so as to form a gap 50 between the wall and the respective vane end 38, 40. (Since the ledge on outer shroud wall 26 is a mirror image of the ledge 48 on inner shroud wall 24, the description and illustration of ledge 48 in relation to wall 24 will suffice for both.) The ledge 48, and consequently the gap 50, extend from the first terminus 44 of the continuous rigid connection 42 at the trailing edge 32 along the pressure side 34 to the second terminus 46 of the connection 42 at the intermediate location along the vane pressure side 34. Preferably, the gap 50 extends along the vane pressure side 34 approximately forty percent of the chord length of the vane ends 38, 40.

It will be seen, therefore, that the portion of the upper and lower vane ends 38, 40 bordering the upper and lower gaps 50 are free to thermally expand relative to the remaining portions of the vanes 28. An alternate construction of the assembly can be a cast assembly in which the gap is cut out from the cast material at the desired region of the intersection of the shroud walls and vane ends corresponding to gap 50 in assembly 22.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. A turbine vane assembly of a gas turbine engine, comprises:

(a) an inner shroud wall;

(b) an outer shroud wall;

(c) at least one airfoil-shaped vane having opposite ends and extending between and rigidly connected at its opposite ends with said inner and outer shroud walls; and (d) a recessed ledge defined in each said shroud walls along respective ones of said ends of said vane, each ledge forming a gap between said respective wall and said vane end extending from a trailing edge pressure side of said vane along said pressure side to a location approximately midway between said trailing edge and a leading edge of said pressure side of said vane.

2. The turbine vane assembly as recited in claim 1, wherein each said gap extends along said vane pressure side approximately forty percent of the chord length of said vane end.

3. In a turbine vane assembly of a gas turbine engine, including an inner shroud wall, an outer shroud wall, and a plurality of airfoil-shaped vanes extending between said walls, each of said vanes having leading and trailing edges, opposite pressure and suction sides, and opposite upper and lower ends, an improved construction for mounting each vane end to a corresponding shroud wall, said mounting construction comprising:

(a) a continuous rigid connection between said shroud wall and said vane end extending from a first terminous at said trailing edge, along said suction side to said leading edge suction side, around said leading edge, and to a second terminus along said pressure side located approximately intermediate of said leading and trailing edges of said vane pressure side; and (b) a recessed ledge defined in said wall which forms a gap between said wall and said vane end extending from said first terminus of said continuous rigid connection at said trailing edge, along said pressure side to said second terminus of said connection at said intermediate location along said vane pressure side.

4. The turbine vane assembly as recited in claim 3, wherein each gap extends along said vane pressure side approximately forty percent of the chord length of said vane end.

* * * * *